United States Patent [19]

Novoryta et al.

[11] 4,069,864

[45] Jan. 24, 1978

[54] GAS FILLED SWIVEL JOINT FOR CRYOGENIC HEAT PIPES

[75] Inventors: Robert John Novoryta; Frederick Wilbur Dawson, both of Littleton, Colo.

[73] Assignee: Martin Marietta Corporation, Rockville, Md.

[21] Appl. No.: 700,366

[22] Filed: June 28, 1976

[51] Int. Cl.[2] ..... F28F 5/00

[52] U.S. Cl. ..... 165/86; 165/105; 165/185; 403/131; 403/143

[58] Field of Search ..... 165/86, 105, 104 R, 165/185, 96; 285/261; 403/143, 131

[56] References Cited

U.S. PATENT DOCUMENTS

| | | | |
|---|---|---|---|
| 2,726,881 | 12/1955 | Howard | 285/261 X |
| 3,249,338 | 5/1966 | Malan | 285/263 X |
| 3,450,196 | 6/1969 | Bauer | 165/32 |
| 3,702,533 | 11/1972 | Dirne et al. | 165/96 X |
| 3,831,664 | 8/1974 | Pogson | 165/105 X |

*Primary Examiner*—Albert W. Davis, Jr.
*Attorney, Agent, or Firm*—Sughrue, Rothwell, Mion, Zinn and Macpeak

[57] ABSTRACT

In a vacuum environment such as space, conductive ball and socket members are fixed to respective heat pipes for permitting orthogonal movement of one heat pipe relative to the other and the gap between the ball and socket members is maintained under a light gas pressure with the low pressure gas forming a low thermal impedance path across the gap.

10 Claims, 3 Drawing Figures

FIG. 1
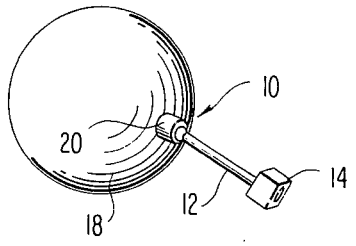
FIG. 2
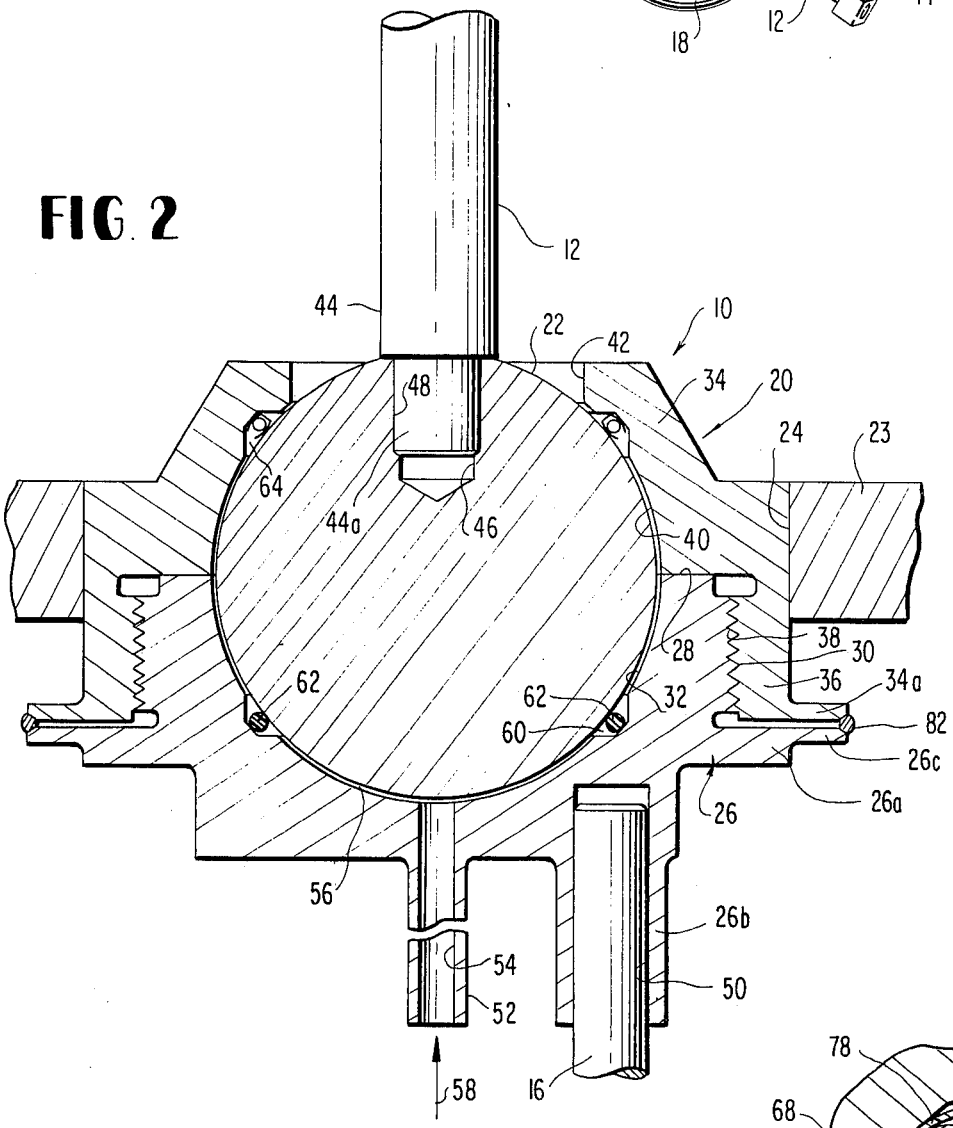
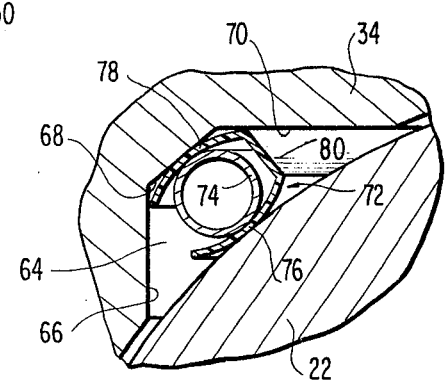
FIG. 3

GAS FILLED SWIVEL JOINT FOR CRYOGENIC HEAT PIPES

BACKGROUND OF THE INVENTION

1. FIELD OF THE INVENTION

This invention relates to the cryogenic field, and more particularly, to an arrangement for effecting a low thermal impedance path between two relatively movable cryogenic heat pipes within a vacuum environment.

2. DESCRIPTION OF THE PRIOR ART

Heat transfer has been effectively achieved in space and other low vacuum conditions by the use of a heat pipe consisting of an envelope or tube carrying internally on the surface or by separate member a capillary flow path and being provided with a mass of vaporizable working fluid such that by heating one end of the tube, working fluid in liquid form is vaporized and travels through the internal space of the tube to its other end, where heat is rejected during condensation of the working fluid. The condensed working fluid by capillary action travels back to the end of the tube being subjected to heat input and is again vaporized to repeat the process.

Conventionally, wick material such as a porous mesh screen or the like forms the capillary transport structure internally of the heat pipe tube and extends from end to end. Such heat pipes have been employed particularly in the cryogenic field under spacecraft applications where heat may be transmitted in the absence of a gravity field, since the liquid moves by capillary or wick effect, irrespective of the presence or absence of gravity. Obviously, in a static arrangement, a heat conductive member such as metal may be employed for connecting the end of one heat pipe to the end of another to effect a low thermal impedance path between multiple heat pipes in a given system. However, where the heat pipes are carried by members which continuously move relative to each other or which may be angularly adjusted relative to each other, the means permitting such relative movement creates a very high thermal impedance path at the interface between the two moving members forming elements of the joint means between respective heat pipes.

SUMMARY OF THE INVENTION

The present invention is directed to a movable joint structure for an assembly subjected to cryogenic temperatures and including first and second heat pipes. Interengaging, relatively movable heat conductive heat pipe support members defining a gap therebetween are fixed respectively to said heat pipes. The invention resides in the maintenance of a pressurized gas within said gap between said members to effect a low impedance heat path across said gap and between said relatively movable, interengaging heat pipe support members. The interengaging members of the heat joint structure may effect mounting of the heat pipes for sliding movement relative to each other, for rotation about one axis or for orthogonal movement about multiple axes. In one embodiment of the invention, the movable joint structure comprises a first member forming a spherical cavity and a second ball-shaped member of a slightly smaller diameter than that of the cavity and carried therein. The first movable joint member may comprise threaded socket halves, one of which is essentially a cup socket half and the other an annular ring socket half with a reduced diameter opening on the end of the ring socket half remote from the cup socket half. One socket half is preferably in threaded engagement with the other socket half, and said ball-shaped member includes a cylindrical, integral, radially projecting portion extending through said reduced diameter opening. The cup socket half may include an annular groove within the inner surface, below the lip of the same and a split ring may be provided within said recess and bear at radially spaced positions on the periphery of the ball-shaped member to space the ball-shaped member slightly from the spherical cavity of said cup socket half. The ring socket half, may further be provided with an annular groove adjacent said reduced diameter opening and a seal ring may be positioned within that annular groove compressed between the periphery of the ball-shaped member and the ring socket half to form a gas seal therebetween and prevent escape of pressurized gas from said movable joint outwardly through said reduced diameter opening of said ring-shaped socket half. At least one gas inlet pipe is coupled to one of said socket halves for delivering gas under pressure to the gap between the ball-shaped member and said socket halves.

BRIEF DESCRIPTION OF THE DRAWINGS

FIG. 1 is a perspective view of a cryogenic storage tank incorporating a gas filled cryogenic ball joint of the present invention between a heat pipe of an infra-red sensor and a heat pipe internally of the cryogenic storage tank.

FIG. 2 is a sectional view of the gas filled cryogenic ball joint employed in the cryogenic storage tank of FIG. 1.

FIG. 3 is an enlarged, sectional view of a portion of the cryogenic ball joint of FIG. 2.

DESCRIPTION OF THE PREFERRED EMBODIMENT

The gas filled swivel or ball joint for cryogenic heat pipes of the present invention has application to the cryogenic field in general, particularly under vacuum conditions. However, in FIG. 1, the gas filled cryogenic swivel joint indicated generally at 10 forms a connection between a heat pipe 12 coupled at its radially outboard end to an infra-end heat sensor 14, to a second heat pipe 16, FIG. 2, which is not seen in the perspective view of FIG. 1. In that regard, the cryogenic storage tank 18 acts as a static mount for a composite socket assembly 20 which rotatably carries a ball member 22 to which heat pipe 12 is directly mechanically fixed to form a low thermal impedance path between heat pipe 12 and the ball member 22.

The gas filled swivel or ball joint 10 may be better seen by reference to the sectional view of FIG. 2 wherein the casing 23 of tank 18 is provided with a circular opening 24 within which the composite socket assembly 20 is seated and supported by means (not shown). The socket assembly comprises an internal or cup socket half 26 formed of a high thermal conductivity metal such as copper or steel or the like and being provided with a flange portion **26*a* and axially spaced from its lip or edge 28 with the outside wall therebetween threaded as at 30. The socket half 26 defines a spherical cavity formed by a spherical inner wall 32, within which is received a portion of the ball-shaped member 22. Threadably coupled to the cup socket half 26 is a ring socket half 34 which is annular in form and which is provided with a radially enlarged, axially projecting flange portion 36 which is internally threaded at 38 and threadably engaged with the threads 30 of the socket half 26. Further, the ring socket half 34 is provided with a spherical inner wall 40 which is complementary to and acts as an extension of the spherical inner wall 32 of cup socket half 26. Unlike cup socket half 26, however, the ring socket half 34 is provided with a circular opening or bore 42 within the end of the same remote from the socket half 26, through which projects the heat pipe cylindrical adapter 44 upon which heat pipe 12 is mounted. Adapter 44 functions as a steerable head to permit the angulation of the heat pipe 12 relative to the socket assembly 20. The ball member 22 is provided with a bore 46 partially extending through the same counterbored at 48 and receiving a reduced diameter portion 44*a* of the adapter 44. The portion 44*a* may be force fit within counterbore 48 or the members may be appropriately threaded for threaded engagement therebetween. Of necessity, the connection between the adapter and the ball member 22 of the ball and socket joint must be one which achieves a minimum thermal impedance path. Socket half 26 includes a cylindrical projecting portion 26*b* which is bored at 50 and closely receives and fixedly carries one end of heat pipe 16** to define a low thermal impedance path between these members.

The present invention is directed primarily to the means for forming a low thermal impedance path between the ball member 22 and the socket assembly 20 making up the cryogenic heat pipes, and in that respect, the socket half 26 is provided with an integral nipple 52 constituting a passageway 54 acting as a gas inlet to the gap 56 formed between the spherical surface of the ball member 22 and the spherical walls 32 and 40 of the socket halves 26 and 34 respectively. Gas under relatively low pressure is supplied to the passage 54 by means (not shown) as indicated by arrow 58 such that the gas passes into the gap 56 between the opposed spherical surfaces of ball member 22 and socket assembly 20. In order to facilitate the dispersion of the gas under the light pressure, the aft socket half 26 is further provided with an annular groove 60 coaxial with gas passage 54 at a point beneath the lip 28 of the cup socket half 26, the annular groove 60 supporting a split spacer ring 62 formed of Teflon or the like, which maintains the periphery of the ball member 22 spaced slightly from the spherical wall 32 of the aft socket half 26. The ring socket half 34 is also provided with an annular groove 64, defined by three intersecting walls 66, 68 and 70 within which is positioned a ring seal assembly indicated generally at 72. Ring seal assembly 72 comprises a tubular O-ring 74 formed of metal or the like which on opposite sides forms line contact with opposed sides 76 and 78 of U-shaped non-metal seal member 80, which is resilient under cryogenic temperatures, being formed of Teflon or the like, the side 78 of that member being pressed against the groove wall 68, while side 76 is pressed against the periphery of the ball member 22. The gas in attempting to escape from inlet passage 54 through the gap 56 between the periphery of the ball member 22 and the socket assembly 20, enters the annular recess of cavity 64. The gas is entrapped in annular cavity 64 being sealed against opposing surfaces 22 and 68, thereby preventing escape. The seal between opposing surfaces 22 and 68 is maintained by a preload deformation not exceeding the elastic range of O-ring 74. This is accomplished by compressing the ring seal 72 whose free dimension is slightly in excess of the gap between opposing faces 22 and 68. Additional positive sealing is derived from the gas entering between sides 76 and 78 of seal member 80, thereby deflecting them apart from each other adding to the sealing force of the already intimate contact of seal sides 76 and 78 with opposing surfaces 68 and 22. The seal assembly 72 is simply exemplary of one type of low pressure seal capable of preventing leakage of the low pressure gas from the gap 56. Because socket assembly 20 comprises two socket halves which are threadedly coupled, it is possible that some gas leakage could occur between the threaded interface of these two members. However to prevent that occurrence, flange **26*a* of the cup socket half 26 terminates in a thin peripheral edge 26*c* of a thickness corresponding to that of lip 34*a* of the ring socket half 34. Once the socket halves have been threaded together, the periphery of lip 34*a* and edge 26*c* are welded as at 82 to form a sealed connection between the threaded socket halves 26 and 34**.

The gas filled swivel joint effects a low impedance path between the cryogenic heat pipes 12 and 16 in the present invention because the thermal conductivity of the gas does not vary over a wide range of pressure, and further use of a low pressure gas yields correspondingly low leakage rates at no sacrifice in thermal performance. Particularly, where the joint is formed between members permitting orthogonal movement such as the ball and socket assembly of the illustrated embodiment of the invention, the application of gas under pressure as evidenced by arrow 58 within gap 56 also creates a low friction gas bearing between these relatively movable members permitting relative movement of the ball member with respect to the socket member with little resistance to such movement. This may not be of primary importance in the illustrated embodiment where angular shifting of the heat sensor 14 with respect to the cryogenic storage tank is permitted. However, where a rotary joint is required between two members which are under constant rotation, the gas film would provide the dual function of effecting a static gas bearing for the rotating member and its heat pipe relative to the stationary member and its heat pipe, while at the same time defining a low impedance path between these cryogenic members. Further, the seal at 72 may not be critical because of the low pressures employed. The gas may be any appropriate gas such as helium and the gas may be supplied to the joint in a number of ways depending upon the particular application.

As long as the gap 56 is several times larger than the mean free path of the molecules found in the gap, then the thermal conductivity through the gap remains essentially constant. One tested configuration, which used helium as the conductive gas, atained 83% of maximum conductance for a gap pressure of 30 torr. The test article had a gap of 0.0024 inches, a conductive gap area of 6.7 square inches, and was tested at an average test temperature of 300° R. The thermal conductance of this switch, at 30 torr of operating helium pressure, was 2.2 watts/° F. Without the gas, the conductance was 0.015 watts/° F. Thus, the presence of the gas improved the thermal conductance by a ratio of 147:1. The measured helium gas leakage for this same test article was $0.15 \times 10^{-7}$ lb/sec at 30 torr and 150° R. (less than 0.5 lb/year). With a reduction in the gap clearance, from 0.0024 inches to slightly less than 0.0012 inches, further improvements in conductance can be realized. Such a change would result in the gas improving the thermal conductance by a ratio of 300 to 1.

The assumed use, of a thermal swivel, having the aforementioned demonstrated performance capability, in a system shown in FIG. 1 would result in a 2° F. temperature drop across the swivel joint for a heat transfer rate of 15 BTU per hour. In the illustrated embodiment, appropriate infrared sensor head cooling would be achieved where the rotary heat pipe joint 10 is employed between the movable sensor head 14 and the remote heat sink.

From the above, it may be seen that the gas bearing for the spherical ball joint permits rigid heat pipes to be employed in lieu of flexible heat pipes, resulting in a less expensive design which is further less resistant to motion, imposes fewer constraints on spacecraft system design and is more reliable than known heat pipe systems operating in extremely low temperature environments where the usual thermal interface material cannot be employed, such as in space or under other vacuum conditions.

With the realization that thermal conductance, and/or temperature drops with and without the low pressure gas may change by factors of 300 to 1, this permits the swivel joint to be selectively made non-conducting and conducting by the simple act of selectively venting or applying gas under low pressure to the swivel joint. In this case, while nipple 52 and gas passageway 54 act as a means for delivering gas under low pressure to gap 56, at another location a second pipe (not shown) may open up to the same gap 56 and by appropriate valving applied gas under pressure can be terminated at passage 54 and the other passage opened to permit venting of the gas already within gap 56. Further, while the illustrated embodiment employs a gas filled swivel joint for providing a low impedance path between cryogenic heat pipes in terms of an infrared sensor and a cryogenic storage tank as evidenced in FIG. 1, the invention has application to a spacecraft structure where a thermal radiator rotates about a given pivot axis on the end of a support arm which in itself may be a heat pipe to be readily swivel connected to a second heat pipe at some angle thereto fixedly mounted on the spacecraft and about which the first heat pipe rotates. Further, while the concept has been described as being particularly applicable to temperature in the cryogenic range, the invention has application to heat pipes through the high temperature range and the low pressure gas provides a low impedance thermal conductivity path which is independent of pressure until the distance $$X \text{ in } Q = KA\,(\Delta T/X)$$

approaches the mean free path of the contained molecules. This is essentially the only limitation on the proposed low impedance path for a swivel connection or joint between cryogenic heat pipes.

While the invention has been particularly shown and described with reference to a preferred embodiment thereof, it will be understood by those skilled in the art that various changes in form and details may be made therein without departing from the spirit and scope of the invention.

What is claimed is:

1. A movable heat conductive joint structure for an assembly subjected to vacuum and low temperature conditions, said joint structure comprising:

first and second heat pipes, interengaging, relatively movable heat conductive heat pipe support members defining a gap of from 0.0012 inches to 0.0024 inches therebetween and being fixed respectively to said heat pipes, and means for maintaining a gas at a pressure of about 30 torr within said gap to effect a low impedance heat path across said gap and between said relatively movable, interengaging heat pipe support members, without impedance to relative movement of said support members.

2. The movable joint structure as claimed in claim 1, wherein said interengaging relatively movable heat conductive heat pipe support members comprise respectively ball and socket members, and said means for maintaining a pressurized gas within the gap between said members comprises conduit means extending through said socket member and opening to said gap between the periphery of the ball member and a spherical surface of said socket member closely receiving said ball member and pressurized gas within said conduit means.

3. The movable joint structure as claimed in claim 1, wherein one of said support members comprises a socket assembly defining a spherical cavity, and said other member comprises a ball member of slightly smaller diameter than that of said spherical cavity, carried within said spherical cavity and movable orthogonally with respect to said socket assembly.

4. The movable joint structure as claimed in claim 3, wherein said socket assembly comprises a large diameter opening within one end of the same, said ball member has a shaft projecting radially through said large diameter opening and thermally coupled to said first heat pipe member and said socket assembly comprises a cylindrical opening fixedly receiving one end of said other heat pipe.

5. The movable joint structure as claimed in claim 4, wherein said means for maintaining a pressurized gas with said gap comprises fluid passage means extending through said socket assembly and opening into said spherical cavity for directing pressurized gas to said gap at the side of said socket assembly opposite that of said large diameter opening through which said ball member shaft projects and said socket assembly further comprises an annular groove concentric with said fluid passageway within the spherical cavity and adjacent said large diameter opening and annular resilient seal means carried within said annular groove in sealing contact with the periphery of said ball and at least one surface of said groove to prevent escape of low pressure gas from said gap through large diameter opening.

6. The movable joint structure as claimed in claim 5, wherein said socket assembly comprises: threadably engaged ring socket and cup socket halves, and wherein said enlarged diameter opening is formed within said ring socket half and said gas inlet passage is formed within said cup socket half.

7. The movable joint structure as claimed in claim 4, wherein said socket assembly comprises: threadably engaged ring socket and cup socket halves, and wherein said enlarged diameter opening is formed within said ring socket half and said gas inlet passage is formed within said cup socket half.

8. A movable heat conductive joint structure for an assembly subjected to vacuum and low temperature conditions, said joint structure comprising:

first and second heat pipes, interengaging, relatively movable heat conductive heat pipe support members, said heat pipe support members being fixed respectively to said heat pipes, one of said support members comprising a socket assembly defining a spherical cavity and the other support member comprising a ball member of slightly smaller diameter than that of said spherical cavity and being carried within said spherical cavity and movable orthogonally with respect to said socket assembly, said socket assembly comprising a large diameter opening within one end of the same, said ball member having a shaft projecting radially through said large diameter opening and thermally coupled to said first heat pipe member, said ball member and said socket assembly forming a gap, said socket assembly comprising a cylindrical opening fixedly receiving one end of said other heat pipe, means for maintaining a gas under light pressure within said gap to effect a low impedance heat path across said gap and between said heat pipe support members without impedance to the relative movement of said support members, said means for maintaining a gas under light pressure within said gap comprising fluid passage means extending through said socket assembly and opening into said spherical cavity for directing gas under pressure to said gap at the side of said socket assembly opposite that of said large diameter opening through which the ball member shaft projects, and said socket assembly further comprising an annular groove concentric with said fluid passageway within said spherical cavity and adjacent said large diameter opening, annular resilient seal means carried within said annular groove in sealing contact with the periphery of said ball and at least one surface of said groove to prevent escape of low pressure gas from said gap through said large diameter opening, a second annular groove within said socket assembly cavity coaxial with said first groove and positioned intermediate of said first groove and said gas passage, and split ring means positioned within said groove and in contact with the periphery of said ball for maintaining said gap between said ball and said spherical cavity wall and for permitting distribution of said low pressure gas between the opposed surfaces of the ball periphery and the socket cavity to effect creation of a low thermal impedance path between said ball and socket members.

9. The movable joint structure as claimed in claim 6, wherein said socket assembly comprises: threadably engaged ring socket and cup socket halves, and wherein said enlarged diameter opening is formed within said ring socket half and said gas inlet passage is formed within said cup socket half.

10. The movable joint structure as claimed in claim 9, wherein said cup socket half comprises axially extending threads on a radially outer face, said ring socket half comprises an axially projecting portion overlying a portion of said cup socket half and having internal threads threadably engaging the threads of said cup socket half and said socket halves include radially projecting portions in axial confronting position at one end of the threaded peripheral portion, and a weld between said radially projecting portions of respective socket halves to effect a leakproof seal therebetween.

* * * * *